US010161423B2

(12) United States Patent
Rampen et al.

(10) Patent No.: US 10,161,423 B2
(45) Date of Patent: Dec. 25, 2018

(54) FLUID POWER DISTRIBUTION AND CONTROL SYSTEM

(75) Inventors: William Hugh Salvin Rampen, Edinburgh (GB); Niall James Caldwell, Edinburgh (GB); Uwe Bernhard Pascall Stein, Edinburgh (GB); Pierre Joly, Edinburgh (GB); Michael Richard Fielding, Edinburgh (GB)

(73) Assignee: Sauer-Danfoss ApS, Nordborg (DK)

( * ) Notice: Subject to any disclaimer, the term of this patent is extended or adjusted under 35 U.S.C. 154(b) by 1229 days.

(21) Appl. No.: 12/374,454

(22) PCT Filed: Jul. 19, 2007

(86) PCT No.: PCT/GB2007/002747
§ 371 (c)(1),
(2), (4) Date: Oct. 13, 2009

(87) PCT Pub. No.: WO2008/009950
PCT Pub. Date: Jan. 24, 2008

(65) Prior Publication Data

US 2010/0037604 A1 Feb. 18, 2010

(30) Foreign Application Priority Data

Jul. 21, 2006 (GB) ..... 0614534.6

(51) Int. Cl.
*F15B 11/17* (2006.01)
*F15B 11/044* (2006.01)
*F15B 11/16* (2006.01)

(52) U.S. Cl.
CPC ..... *F15B 11/17* (2013.01); *F15B 11/0445* (2013.01); *F15B 11/162* (2013.01); (Continued)

(58) Field of Classification Search
CPC ..... F15B 11/17; F15B 2211/2656; F15B 2211/633
(Continued)

(56) References Cited

U.S. PATENT DOCUMENTS 4,020,867 A 5/1977 Sumiyoshi
4,369,625 A * 1/1983 Izumi et al. ..... 60/429
(Continued)

FOREIGN PATENT DOCUMENTS

EP 91801 10/1983
EP 76485 1/1986
(Continued)

*Primary Examiner* — F. Daniel Lopez
(74) *Attorney, Agent, or Firm* — McCormick, Paulding & Huber LLP

(57) ABSTRACT

A fluid power system comprises a pump with multiple independently variable outlets (11, 12, 13, 14), each of which is capable of delivering fluid in individually controllable volume units and a plurality of hydraulic loads (15, 16, 18, 20). A system of switching valves is configured to create fluid connections between the pump outlets and the loads. A control system commands both the pump and the switching valves, so as to create valve state combinations to satisfy load conditions as demanded by an operator. The number of pump outlets (11, 12, 13, 14) connected to one or more of the loads (15, 16, 18, 20) is changeable to satisfy the flow required of the load due to the operator demand, each pump outlet being commanded to produce a flow depending on the status of other outlets connected a load to which the outlet is connected and the operator demand for that load.

4 Claims, 3 Drawing Sheets

(52) U.S. Cl.
CPC ..... *F15B 2211/20546* (2013.01); *F15B 2211/20569* (2013.01); *F15B 2211/20576* (2013.01); *F15B 2211/265* (2013.01); *F15B 2211/2656* (2013.01); *F15B 2211/3127* (2013.01); *F15B 2211/327* (2013.01); *F15B 2211/5059* (2013.01); *F15B 2211/6052* (2013.01); *F15B 2211/6054* (2013.01); *F15B 2211/633* (2013.01); *F15B 2211/6313* (2013.01); *F15B 2211/6346* (2013.01); *F15B 2211/7052* (2013.01); *F15B 2211/7053* (2013.01); *F15B 2211/7058* (2013.01)

(58) Field of Classification Search
USPC ..... 60/429
See application file for complete search history.

(56) References Cited

U.S. PATENT DOCUMENTS

| | | | | |
|---|---|---|---|---|
| 5,259,738 | A * | 11/1993 | Salter et al. | 417/270 |
| 5,456,581 | A * | 10/1995 | Jokela et al. | 417/270 |
| 5,471,837 | A | 12/1995 | Bianchetta | |
| 6,502,393 | B1 * | 1/2003 | Stephenson | F15B 11/006 60/414 |
| 6,681,571 | B2 * | 1/2004 | Bailey et al. | 60/429 |
| 6,772,589 | B2 * | 8/2004 | Schienbein | B29C 45/82 60/421 |
| 7,628,240 | B2 * | 12/2009 | Caldwell | 180/242 |
| 2001/0035011 | A1 | 11/2001 | Endo et al. | |
| 2006/0236688 | A1 | 10/2006 | Ioku | |

FOREIGN PATENT DOCUMENTS

| | | |
|---|---|---|
| EP | 361927 | 4/1990 |
| EP | 494236 | 7/1992 |
| EP | 1286058 | 2/2003 |
| GB | 1436829 | 5/1976 |
| GB | 2243879 | 11/1991 |
| GB | 2416604 | 10/2006 |
| WO | 2004/025122 | 3/2004 |
| WO | 2006/011836 | 2/2006 |

* cited by examiner

FLUID POWER DISTRIBUTION AND CONTROL SYSTEM

PRIORITY APPLICATIONS

This application is a 371 application of International Application No. PCT/GB2007/002747 filed Jul. 19, 2007, which claims priority to United Kingdom Patent Application No. 0614534.6 filed Jul. 21, 2006. The entire disclosure of each of the foregoing applications is hereby incorporated herein by reference.

BACKGROUND TO THE INVENTION

This invention relates to a fluid power system.

In their most basic form, fluid power systems generally consist of a pressurised fluid source, a motion control valve and an actuator such as a ram or a motor. Systems are typically generalised by attaching further motion control valves in parallel to the first so that additional actuators can be moved with the power supplied by the fluid source. Because most actuators have a fixed linear or rotary movement per unit of fluid displacement, the force they exert is directly proportional to the pressure supplied. In systems with a single pump and multiple actuators there is always undesirable compromise given the practical impossibility of matching the instantaneous pressure requirements of all of the active actuators to the single pressure supply.

In the case of the state-of-the-art "load sensing" system, the displacement of a variable displacement pump is controlled such as to maintain its output pressure to a fixed margin above the maximum pressure required of any of the loads. The difference between this pressure and the actual pressure required of any one of the loads is throttled in a proportional valve, creating energy losses. When only one actuator is moved at a time these systems can be reasonably efficient. However when multiple actuators must be moved simultaneously at different pressures then the efficiency becomes poor—depending on the duty cycle, these losses can cause the overall efficiency of such a system to reduce to 30%.

The pump/motor described in EP 0494236 B1 and sold under the trade mark Digital Displacement is a positive-displacement fluid pump/motor in which the working volumes are commutated not by mechanical means but by electronically-controlled solenoid-actuated poppet valves. Control of flow is achieved by varying the time-averaged proportion of working volumes which are commutated such as to pump fluid from the low pressure port to the high pressure port ("pump enabled"), or which are commutated such as to motor fluid from the high pressure port to the low pressure port ("motor enabled"), to the proportion which are connected in both expansion and contraction strokes to the low pressure port and thus do no fluid work ("idled"). A controller, synchronised to the position of the shaft by means of a position sensor, supplies pulses to the solenoid coils at the appropriate times such as to commutate each working volume as desired. Because the commutation of each stroke of the working volume is independently controllable, the pump/motor is capable of supplying fluid to or absorbing fluid from a port, in individual discrete volume units, each corresponding to a single stroke or part of a stroke (see WO 2004/025122) of a single working volume. The high pressure port of each working volume may be connected to a different fluid circuit. Thus a single pump/motor composed of many working volumes may provide multiple independent fluid supplies or sinks, the flow to or from each of which is independently variable.

WO 2006/011836 describes a system in which two separate pumps can be connected to first and second load outlet points in different configurations.

SUMMARY OF THE INVENTION

The present invention provides a system that couples independent services from a pump, e.g. a pump according to EP 0361 927 B1 or a pump/motor according to EP 0494236 B1, to a multiplicity of different actuators, or loads, in a way that provides complete decoupling of the different load pressures, such that interactions between load responses are avoided, and so that each service works only at the pressure required by its actuator. (References to a "pump" in this description and in the claims include the possibility of a pump/motor unless the context requires otherwise. References to a "hydraulic motor" also include the possibility of a pump/motor.) The invention allows additional pump/motor services to be both switched into and out of a single load while the load is in motion.

The system uses the ability of pumps according to EP 0361 927 B1 or pump/motors according to EP 0494236 B1 to provide a number of independent and fully controllable fluid supplies from one compact package with a single input shaft. By coupling combinations of these supplies to the loads, the control of multiple independent loads can be achieved at higher energy efficiency.

The invention thus provides a fluid power system according to claim 1, preferred or optional features of the invention being set out in the dependent claims.

The system comprises:

a fluid working machine with a plurality of ports each capable of supplying (pumping) or absorbing (motoring) pressurised fluid in individually commandable fluid units, such that the time averaged flow to or from each port is independent, which when working as a pump efficiently converts mechanical shaft energy into fluid power at the port, and when working as a motor efficiently converts fluid power at the port to shaft power;

a plurality of hydraulic loads, each consisting of an actuator such as a ram or a fluid motor, provided with one or more fluid ports such that the actuator may be moved by supplying pressurised fluid to or absorbing pressurised fluid from the port(s), and a mechanical load such as a wheel in contact with the ground or an arm which does mechanical work such as digging the earth, and (optionally) load control valves such as overcentre ("counterbalance") valves such that the position of the ram or motor may be controlled by delivering fluid into either of the two fluid ports regardless whether the direction of force on the actuator is against or with the direction of motion;

a system of switching valves configured to create fluid connections between pump/motor ports and loads, each valve having a number of discrete states, whereby certain combinations of valve states serve selectively to supply fluid to one or more of the load ports from one or more of the pump/motor ports in one or more distinct and separate fluid paths;

a control system, which commands both the fluid working machine and the switching valves, so as to both create valve state combinations to satisfy load conditions as demanded by an operator, the valve state combination being changeable such as to change the number of pump/motor outlets, connected to one or more of the loads, to satisfy the flow required of the load due to the operator demand, each pump/motor being commanded to produce or absorb a flow depending on which load port it is connected to and the status of other pump/motor ports connected to that load and the operator demand for that load, such that when the flow demand of a load port increases beyond the capability of a single pump/motor to supply it, another pump/motor is connected to the load by changing the state of the switching valve system, the sequence of valve switching events and commanded outlet flows being such as to continuously maintain the load flow demanded by the operator.

Individual fluid supplies from a Digital Displacement pump can be switched quickly from being controlled by a flow demand to being controlled by a pressure demand, the latter being achieved using a control loop with feedback from a pressure transducer.

Fluid supplies which are provided with feedback by means of a hydraulic pressure signal can also be controlled to maintain a certain power output. Such power control mode may be entered when the power demanded by the operator exceeds the power limit which is imposed on that particular load.

Prime movers such as diesel engines have a maximum power limit. If all loads are provided with pressure sensors which send signals to the controller, then it is possible for the controller to sum the power absorbed by each load and to compare this power with the power limit of the prime mover. In case the total power demanded by the loads would exceed the power limit, the controller reduces the flow commands to the pump services such that the total power is less than the power limit. Such reduction may be done according to a priority algorithm such that less important loads are reduced in preference to more important loads.

It is also possible for the controller to infer the power load on the engine by measuring the speed of the prime mover shaft. By means of the controller having an internal model of the relationship between prime mover load and speed, and a signal giving the controller information about the speed of the shaft, it is possible for the controller to measure the power imposed upon the prime mover by the pump by measuring the speed. If the power measured by this means exceeds the power limit of the prime mover, then the flow commands to the pump services may be reduced as mentioned in the previous paragraph.

Additionally the control system may be adapted to control one or more of the fluid outlets capable of working as a pump/motor, such that energy is delivered to or absorbed from a gas-filled accumulator, so as to buffer the torque load exerted on the prime mover, such that a smaller prime mover may be fitted than would normally be the case if the instantaneous peak torques of the duty cycle had to be supplied by the engine alone.

In the most general case the valve circuit allows any of the pump supplies to be connected to any of the loads; however in some cases it may be desirable to reduce the cost of the system by eliminating some of these possible connections. In this case the controller must have the information of which fluid connections are possible.

BRIEF DESCRIPTION OF THE DRAWING

The invention will now be described in more detail, by way of example only, with reference to the accompanying drawings.

DETAILED DESCRIPTION OF A PARTICULAR EMBODIMENT

Figure 1:
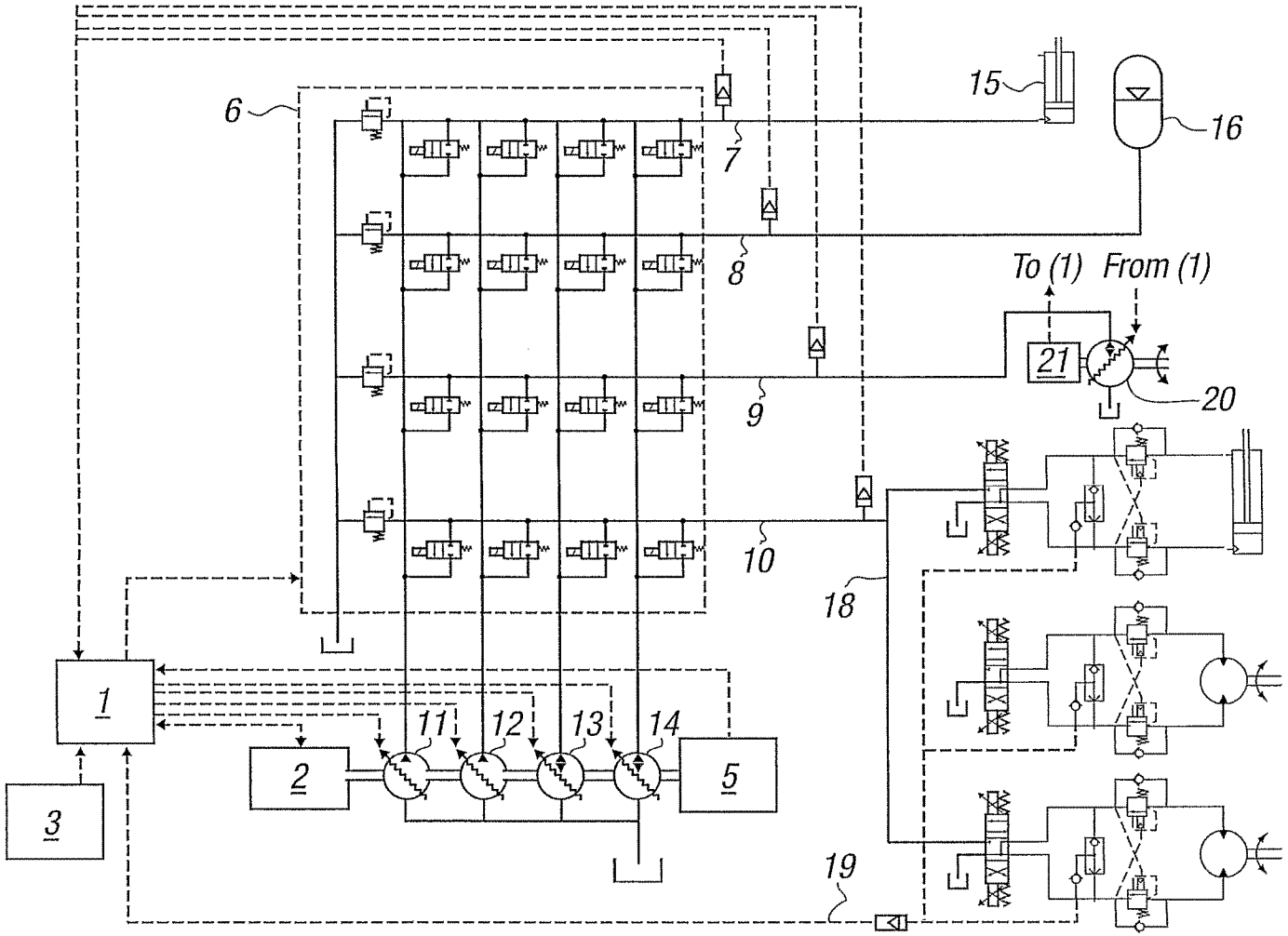
FIG. 1 schematically shows a system according to an embodiment of the invention.
Figure 2:
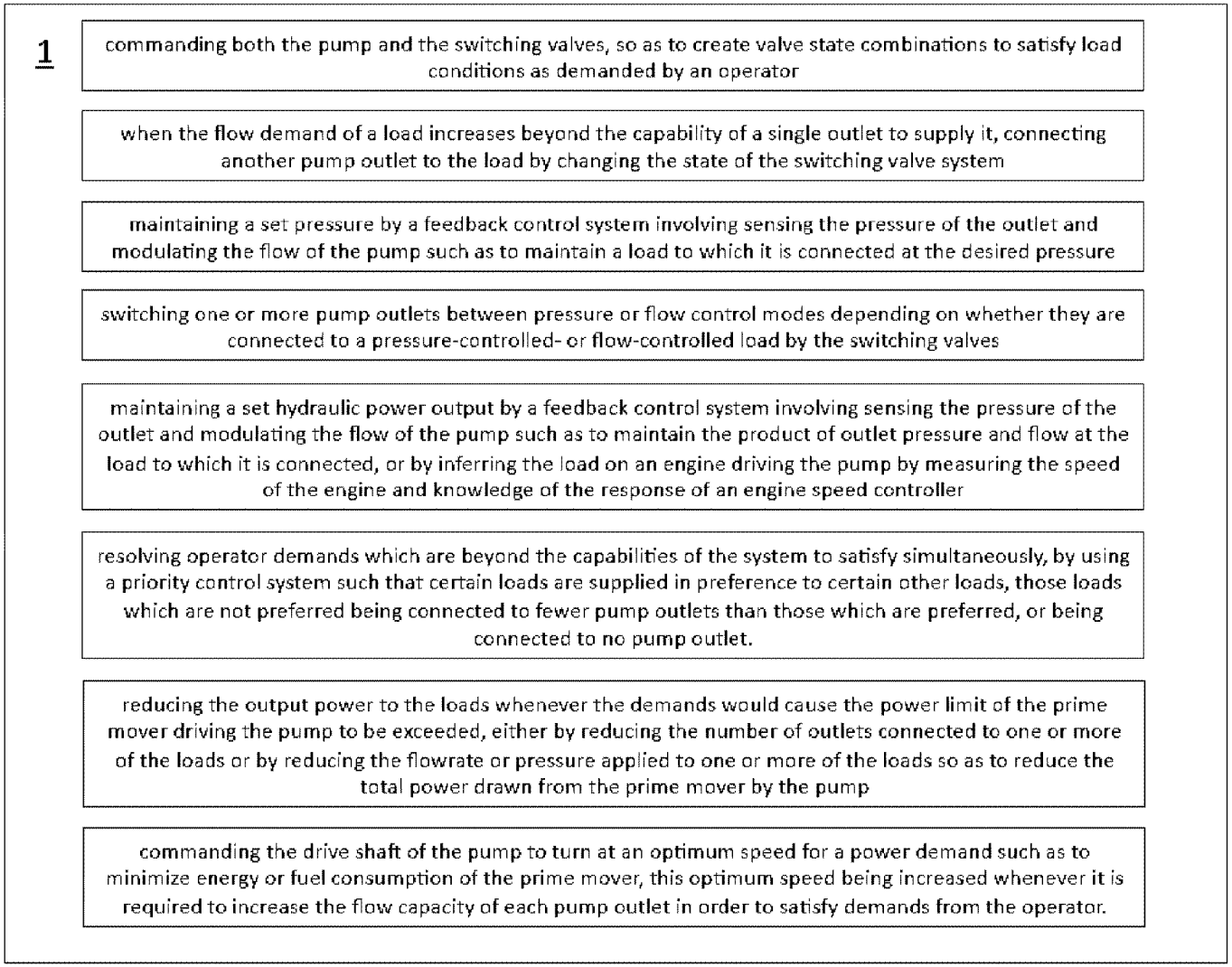
FIG. 2 shows an exemplary embodiment of a control system.
Figure 3:
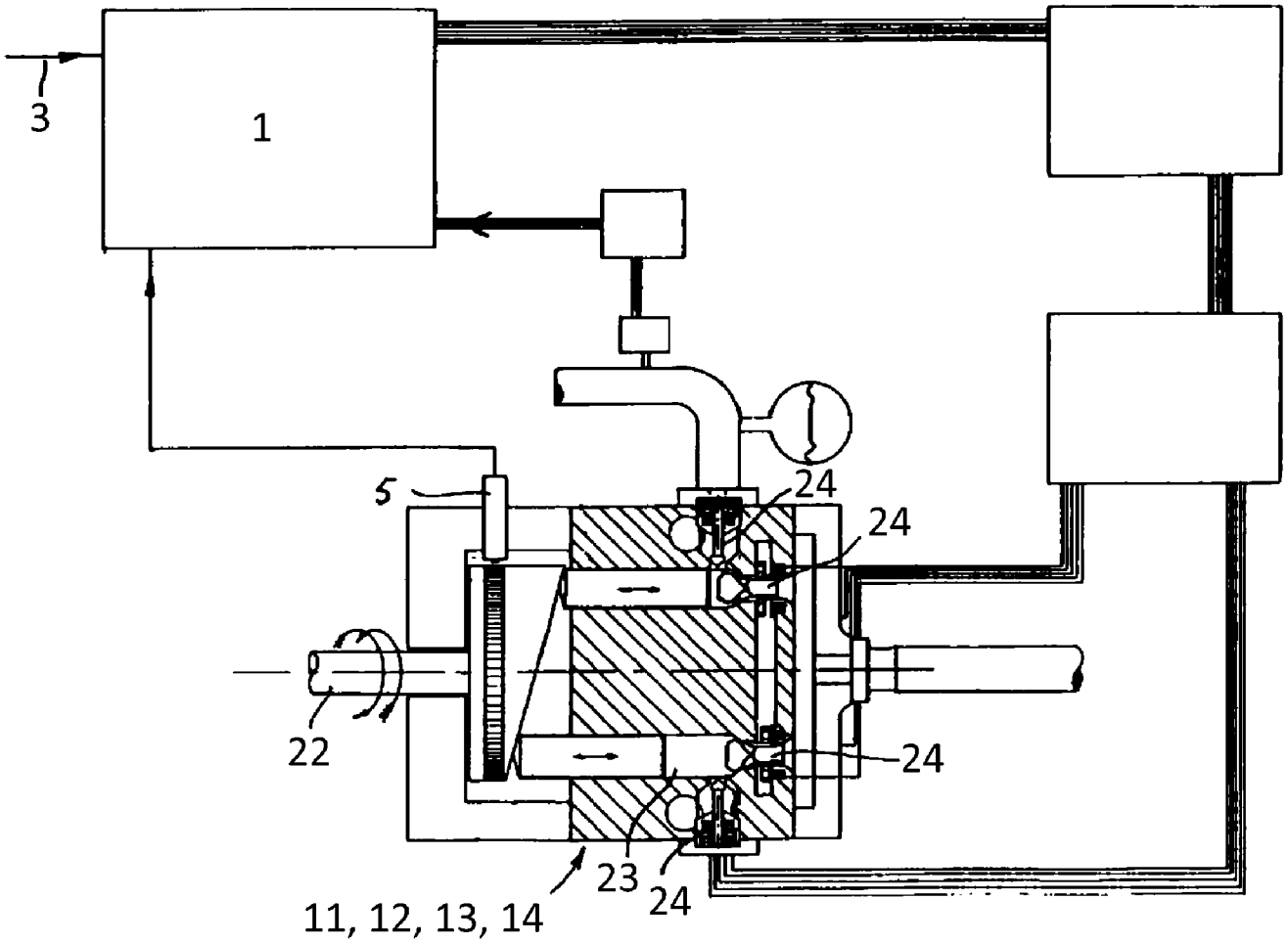
FIG. 3 shows an exemplary embodiment of a fluid working machine.

The drawing shows a pump/motor with four independent fluid supplies, two of which 11, 12 are pump outlets, two of which 13, 14 are pump/motor outlets, and each of which is controlled by a controller 1. Mechanical power comes into the pump/motor unit via its shaft 22 from a prime mover 2, which may take a speed demand signal from the controller 1. The fluid working machines 11, 12, 13, 14 may be configured as pumps according to EP 0361 927 B1 or pump/motors according to EP 0494236 B1. Each fluid working machine 11, 12, 13, 14 comprises one or more working chambers 23 and one or more commutating valves 24. A control system 1 is provided to supply pulses to the commutating valves 24 of the fluid working machines 11, 12, 13, 14. The pump/motor unit uses the ability of pumps according to EP 0361 927 B1 or pump/motors according to EP 0494236 B1 to provide a number of independent and fully controllable fluid supplies from one compact package with a single input shaft 22.

The switching circuit 6 in this embodiment consists of digital solenoid valves in a matrix arrangement such that any of the fluid outlets of the pump/motor 11, 12, 13, 14 may be coupled to any of the load ports 7, 8, 9, 10. These valves are controlled by the controller 1. Each of the load ports 7, 8, 9, 10 is protected from overpressure by a safety relief valve.

The first load port 7 is connected to a single acting ram 15. The pressure supply has a pressure sensor feeding a signal to the controller. The operator demands a certain pressure be maintained on the ram, however the system is also capable of controlling the flow to the ram, for instance if the flow required to meet the pressure demand exceeds a preset flow limit. In the case of a double-acting ram or a bidirectional fluid motor, a directional control valve may be provided to allow bidirectional movement of the ram, and load-control valves such as overcentre valves may be provided such that the ram may be moved in both directions regardless of the direction of force on the ram.

The second load port 8 is connected to a gas-charged accumulator. This is capable of storing energy as gas pressure and returning it back as fluid energy at a later time.

The third port 9 is connected to a hydraulic motor 20. The operator demands a certain flowrate with a certain direction be supplied to the motor, however the system is also capable of controlling the pressure to the motor, for instance if the pressure required to meet the flow demand exceeds a preset pressure limit.

In this example, the hydraulic motor 20 is a "Digital Displacement" pump/motor and the controller 1 sends pulses to the commutating valves of the motor, synchronised with the position of the motor shaft by means of a motor shaft position sensor 21. The direction of the rotation of this pump/motor is determined by the phasing of the commutating pulses relative to the shaft as implemented by the controller.

The fourth load port 10 is connected to a pressure supply 18 to three separate flow-compensated proportional valves with a load sensing arrangement, each of which controls the flow to a separate hydraulic work function, each of which is provided with load-control valves. The operator controls the proportional valves, and an arrangement of shuttle and check valves feeds the highest pressure required of any of the loads back to the controller via a transducer. The pump is controlled to maintain the pressure in the supply line some margin above the pressure in the load sense line, however the system is also capable of controlling the flow to the valves, for instance if the flow required to meet the pressure demand exceeds a preset flow limit. It is also possible for one of the load ports to supply a network of open-centre valves, in which case the flow output of this load port may be adjusted according to the setting of the proportional valves such that the minimum excess flow is created.

The controller 1 receives commands from the operator interface 3, receives the feedback from the shaft position sensor 5, receives a pressure signal from sensors connected to each of the load ports 7, 8, 9, 10, receives a pressure feedback signal from the load sense pressure line 19, sends commands to the digital valves which need to be activated inside the valve circuit 6 to connect the fluid supplies 11, 12, 13, 14 to the loads ports 7, 8, 9, 10, and sends pulses to the fluid working machines 11, 12, 13, 14 such that the load ports 7, 8, 9, 10 produce or absorb the fluid flow required by the operator through the interface 3 and the load sensing pressure feedback sensor 19, subject to limitation when the pressure in each of the load ports approaches the maximum pressure allowed on each of the load ports 7, 8, 9, 10 or when the total shaft power taken from the prime mover 2 exceeds the maximum which it can provide. The controller may also supply commands to directional control valves associated with one or more of the loads.

The controller 1 can choose to transfer fluid energy from the accumulator 16 to the shaft of the pump/motor for the purposes of buffering the load on the engine such that the sum of the fluid power supplied to the other load ports 7, 9, 10 can temporarily exceed the maximum power output of the prime mover 2, and can provide fluid energy to the accumulator 16 to store energy when the fluid power demands on the other loads 7, 9, 10 are lower than maximum power output of the engine.

In addition, the controller 1 must coordinate the commands to both the valves within the switching block 6 and the fluid working machines 11, 12, 13, 14. If the operator demands dictate that zero flow is required from the load ports 7, 9, 10 then the switching valves inside the block 6 may disconnect the load ports 7, 9, 10 from the fluid working machines 11, 12, 13, 14. When the operator demand dictates that fluid be either sourced from or absorbed to one of the load port 7, 9, 10 then the minimum number of fluid machines capable of fulfilling the flow demand is connected to that load port. As the operator demand changes then the number of fluid working machine ports which are connected to the load port can change depending on the instantaneous demand. In the case that the valves in the block 6 take significant time to change state, then optionally a forecast demand may be used in addition to the instantaneous demand, this forecast demand being based on an extrapolation of the trend of the operator demand or other knowledge which the controller has of the likely future demand, such that the future demand can be met without interruption.

In addition, the controller 1 must balance the requirements of the operator against the limitations of the pump/motor and the switching circuit. The single-acting ram 15 can be supplied with fluid from any of the pump/motor ports 11, 12, 13, 14 via the switching circuit 6, but only certain of the pump/motor ports 13, 14 are capable of absorbing fluid from it.

In addition, in the case of a variable speed prime mover, the controller can send a speed demand signal to the prime mover. This speed demand can be chosen such that the prime mover will at this speed be at its optimum operating point for energy consumption, given the load on the prime mover, but may be overridden under some operating conditions. If the flow demand from the operator for one of loads exceeds the ability of the system to satisfy, and all of the pump/motor units are already committed, then the speed setpoint may be increased above what would be optimum for fuel consumption. The torque on the prime mover and the maximum available torque can either be calculated from the outlet pressures and flows of all the pump/motor units which is known by the controller, or in the case of an electronically-controlled prime mover can be fed back to the controller from the prime mover electronic control unit.

It may be that the variable speed prime mover does not include a speed governor; in this case the controller must supply to the prime mover a torque demand signal, and a feedback control loop is necessary within the controller to maintain the prime mover at the demanded speed. The speed of the prime mover is known to the controller by means of the shaft position sensor 5 or electronic feedback provided by the prime mover electronic control unit.

The controller can operate according to different algorithms, e.g having different ramp times, hysteresis, delay etc. depending on the nature of the load. For example, in a mobile work platform (manlift) a main lift cylinder can be controlled gently to avoid exciting the bounciness of the boom, whilst the auxiliary hydraulic cylinders can be more responsive.

The functions of the controller 1 may be shared across several hardware microcontrollers. For instance, the function of generating the pulses to the commutating valves in the pump/motor, synchronised to the shaft by use of the position sensor signal, may be executed by a first controller. The function of controlling the overall system to the demands of the operator may be executed by a second controller, which may be asynchronous to the shaft. In this case the second controller may send to the first controller a flow rate demand or pressure demand, the generation of the pump/motor commutating valve pulses synchronised with shaft position being left to the first microcontroller. In this way the second controller may execute the overall system control function at regular fixed time steps asynchronous to the shaft position, facilitating rapid development of the system control software.

The invention claimed is:

1. A fluid power system, comprising:

a prime mover;

a pump/motor unit comprising a plurality of independently-variable fluid working machines for delivering and absorbing fluid flow, each of the plurality of fluid working machines comprising one or more working chambers, each working chamber including one or more commutating valves;

a drive shaft connected to the plurality of fluid working machines of the pump/motor unit, the drive shaft being driven by the prime mover;

a system of switching valves; and a control system;

wherein the control system sends pulses to the commutating valves of the plurality of fluid working machines of the pump/motor unit to control operation of the plurality of fluid working machines of the pump/motor unit to deliver fluid or absorb fluid;

wherein the control system commands the switching valves to change between a first valve state combination where a single one of the plurality of fluid working machines of the pump/motor unit is connected to a selected one of the plurality of hydraulic loads and a second valve state combination where two or more of the plurality of fluid working machines of the pump/motor unit are connected to the selected one of the plurality of hydraulic loads to satisfy the load flow required by demanded load conditions;

wherein, in the second valve state combination, each of the two or more of the plurality of fluid working machines connected to the selected one of the plurality of hydraulic loads is commanded to produce a fluid flow depending on the status of the other of the two or more of the plurality of fluid working machines connected to the selected one of the plurality of hydraulic loads and by demanded load conditions;

wherein the switching of the switching valves and commanded fluid flows of the plurality of fluid working machines are adapted to continuously maintain the load flow required by demanded load conditions;

wherein the control system commands one or more of the plurality of fluid working machines of the pump/motor unit to maintain a set pressure rather than a set flowrate by a feedback control system involving sensing the pressure of the one or more pump outlets based on pressure feedback signals from sensors at the one or more pump outlets and modulating the flow of the pump/motor unit such as to maintain each of the plurality of hydraulic loads at their respective demanded pressures to satisfy the demanded load conditions;

wherein the control system is configured to store an internal model of the relationship between the prime mover load and speed of the drive shaft, to receive a signal about the speed of the drive shaft, and to determine the power imposed upon the prime mover by the pump, based on the internal model, by measuring the drive shaft speed.

2. The fluid power system of claim 1, wherein the control system comprises at least two controllers;

wherein a first controller of the at least two controllers is configured to generate the pulses to the commutating valves of the plurality of fluid working machines of the pump/motor unit;

wherein a second controller of the at least two controllers is configured to send a flow rate demand or pressure demand to the first controller.

3. The fluid power system of claim 2, wherein the first controller is synchronized to the shaft by the use of a position sensor signal.

4. The fluid power system of claim 2, wherein the second controller is asynchronous to the shaft position.

* * * * *